US008286814B2

(12) United States Patent
Pritchett, Jr.

(10) Patent No.: US 8,286,814 B2
(45) Date of Patent: Oct. 16, 2012

(54) VOLUMETRICALLY EFFICIENT HOT-FILL TYPE CONTAINER

(75) Inventor: Raymond A. Pritchett, Jr., Brogue, PA (US)

(73) Assignee: Graham Packaging Company, L.P., York, PA (US)

( * ) Notice: Subject to any disclaimer, the term of this patent is extended or adjusted under 35 U.S.C. 154(b) by 1194 days.

(21) Appl. No.: 12/104,893

(22) Filed: Apr. 17, 2008

(65) Prior Publication Data

US 2009/0261058 A1 Oct. 22, 2009

(51) Int. Cl.
*B65D 90/02* (2006.01)

(52) U.S. Cl. ..... 215/381; 215/382; 215/383; 215/261; 215/379

(58) Field of Classification Search ..... 215/382, 215/379, 381, 261, 383
See application file for complete search history.

(56) References Cited

U.S. PATENT DOCUMENTS

| | | | | |
|---|---|---|---|---|
| 5,178,290 | A | 1/1993 | Ota et al. | |
| 5,279,433 | A | 1/1994 | Krishnakumar et al. | |
| 5,337,909 | A | 8/1994 | Vailliencourt | |
| 5,341,946 | A | 8/1994 | Vailliencourt et al. | |
| 5,472,105 | A | 12/1995 | Krishnakumar et al. | |
| 5,704,503 | A | 1/1998 | Krishnakumar et al. | |
| 6,016,932 | A | 1/2000 | Gaydosh et al. | |
| 6,044,996 | A | 4/2000 | Carew et al. | |
| 6,763,969 | B1 * | 7/2004 | Melrose et al. | 220/669 |
| 6,793,969 | B2 * | 9/2004 | Shimogaki et al. | 427/255.36 |
| 6,920,992 | B2 | 7/2005 | Lane et al. | |
| D522,371 | S | 6/2006 | Livingston | |
| 7,258,244 | B2 | 8/2007 | Ungrady | |
| 7,334,695 | B2 | 2/2008 | Bysick et al. | |
| 2003/0015491 | A1 | 1/2003 | Melrose et al. | |
| 2005/0035083 | A1 | 2/2005 | Pedmo et al. | |
| 2005/0150859 | A1 * | 7/2005 | Lane et al. | 215/381 |
| 2005/0218107 | A1 | 10/2005 | Sabold et al. | |
| 2007/0131644 | A1 * | 6/2007 | Melrose | 215/381 |
| 2007/0257004 | A1 * | 11/2007 | Howell et al. | 215/383 |
| 2008/0017604 | A1 | 1/2008 | Livingston et al. | |

FOREIGN PATENT DOCUMENTS

| | | |
|---|---|---|
| JP | 2005-75421 | 3/2005 |
| JP | 2007-39109 A | 2/2007 |
| WO | 01/12511 | 2/2001 |

OTHER PUBLICATIONS

International Search Report dated Oct. 6, 2010 for corresponding PCT/US2009/040469.

* cited by examiner

*Primary Examiner* — Anthony Stashick
*Assistant Examiner* — Cynthia Collado
(74) *Attorney, Agent, or Firm* — The Patentwise Group, LLC

(57) ABSTRACT

A volumetrically efficient plastic hot fill container at least one vacuum panel defined by a vacuum panel area of a sidewall that is constructed and arranged to flex inwardly in order to accommodate volumetric shrinkage that may occur within the container as a result of the conventionally known hot fill process. Advantageously, at least a portion of the vacuum panel area of the sidewall is formed as a plurality of undulations. The undulations preferably have a vertical component and provide an increased surface area to the vacuum panel area relative to what a flat surface would provide. As a result, the amount of volumetric shrinkage that may be accommodated through inward deflection of said vacuum panel area of said sidewall is increased relative to a flat surface would provide.

31 Claims, 3 Drawing Sheets

VOLUMETRICALLY EFFICIENT HOT-FILL TYPE CONTAINER

BACKGROUND OF THE INVENTION

1. Field of the Invention

This invention relates generally to the field of packaging, and more specifically to the field of hot fill type containers.

2. Description of the Related Technology

Hot fill containers are designed to be used with the conventional hot fill process in which a liquid product such as fruit juice is introduced into the container while warm or hot, as appropriate, for sanitary packaging of the product.

After filling, such containers undergo significant volumetric shrinkage as a result of the cooling of the product within the sealed container. Hot fill type containers accordingly must be designed to have the capability of accommodating such shrinkage. Typically this has been done by incorporating one or more concave vacuum panels into the side wall of the container that are designed to flex inwardly as the volume of the product within the container decreases as a result of cooling.

Most hot fill type containers are fabricated from polyethylene terephthalate, which is otherwise known as PET. PET possesses excellent characteristics for such containers, but PET resin is relatively expensive. Accordingly, a PET container design that reduces the amount of material that is used without sacrificing performance will provide a significant competitive advantage within the packaging industry.

Hot fill containers must be designed to be strong enough in the areas outside of the vacuum panel regions so that the deformation that occurs as a result of the volumetric shrinkage of a product within the container is substantially limited to the portions of the container that are designed specifically to accommodate such shrinkage. In order to provide the requisite strength, the wall thickness of the side wall of the container must be formed to a minimum thickness.

Typically, the vacuum panel regions of conventional hot fill containers are characterized by having surfaces that are designed to deflect inwardly when the product within the sealed container undergoes shrinkage. In some instances, an island may be defined in the middle of the vacuum panel in order to provide support for in order to provide support for an adhesive label that may be placed over the container. In other instances, such as is disclosed in U.S. Pat. No. 5,472,105 to Krishnakumar et al., ribs may be molded into the vacuum panel area in order to provide an enhanced grip surface or to enhance the strength of the vacuum panel area. While such designs improve the functionality of certain containers to some extent, they had little to no effect on the volumetric efficiency of the vacuum panel, i.e. the amount of volumetric shrinkage that could be accommodated by a given amount of inward deflection of a vacuum panel having given dimensions.

A need has existed for an improved hot fill container design that possesses improved volumetric efficiency characteristics and that may permit substantial lightweighting of the container without sacrificing container performance.

SUMMARY OF THE INVENTION

Accordingly, it is an object of the invention to provide an improved hot fill container design that possesses improved volumetric efficiency characteristics and that may permit substantial lightweighting of the container without sacrificing container performance.

In order to achieve the above and other objects of the invention, a plastic hot fill container according to a first aspect of the invention includes a sidewall having at least one vacuum panel defined therein, the at least one vacuum panel being defined by a vacuum panel area of the sidewall that is constructed and arranged to flex inwardly in order to accommodate volumetric shrinkage that may occur within the container as a result of the hot fill process, and wherein at least a portion of the vacuum panel area of said sidewall is formed as a plurality of undulations, the undulations having a vertical component and providing an increased surface area of the vacuum panel area of the sidewall relative to what a flat surface would provide, wherein the amount of volumetric shrinkage that may be accommodated through inward deflection of the vacuum panel area of said sidewall is increased relative to a flat surface would provide.

According to a second aspect of the invention, a method of designing a volumetrically efficient hot fill container includes steps of modifying a conventional hot fill container design by designing a vacuum panel area for a volumetrically efficient hot fill container in which a sidewall of the volumetrically efficient hot fill container is formed as a plurality of undulations, the undulations having a vertical component and providing an increased surface area of the vacuum panel area of the sidewall relative to what a flat surface would provide, wherein the amount of volumetric shrinkage that may be accommodated through inward deflection of the vacuum panel area of the a sidewall is increased relative to what a flat surface would provide; and reducing an amount of plastic material to be used in the formation of the volumetrically efficient hot fill container relative to an amount of plastic material that was used to form the conventional hot fill container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
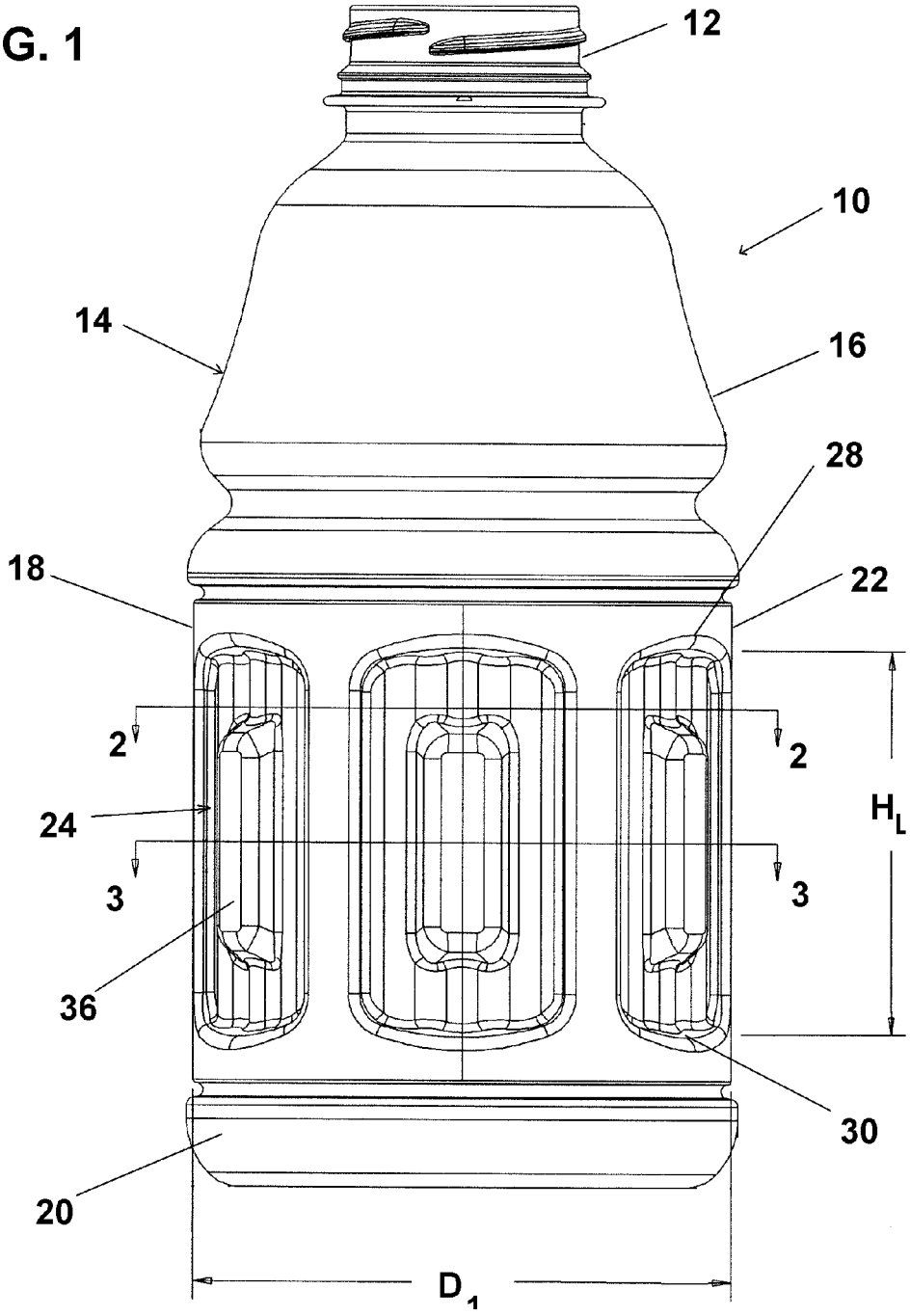
FIG. 1 is a side elevational view of an improved hot fill type container that is constructed according to a preferred embodiment of the invention.

Referring now to the drawings, wherein like reference numerals designate corresponding structure throughout the views, and referring in particular to FIG. 1, an improved plastic hot fill container 10 according to a first preferred embodiment of the invention includes a sidewall 22 that is shaped to define a threaded finish portion 12, a main body portion 14 having a shoulder portion 16, a label panel portion 18 and a bottom portion 20.

Sidewall 22 preferably has a plurality of vacuum panel areas 24 defined therein, which are preferably positioned within the label panel portion 18 of the container 10. Vacuum panel areas 24 are constructed and arranged to flex inwardly in order to accommodate volumetric shrinkage that may occur within the container 10 as a result of the hot fill process.

Figure 2:
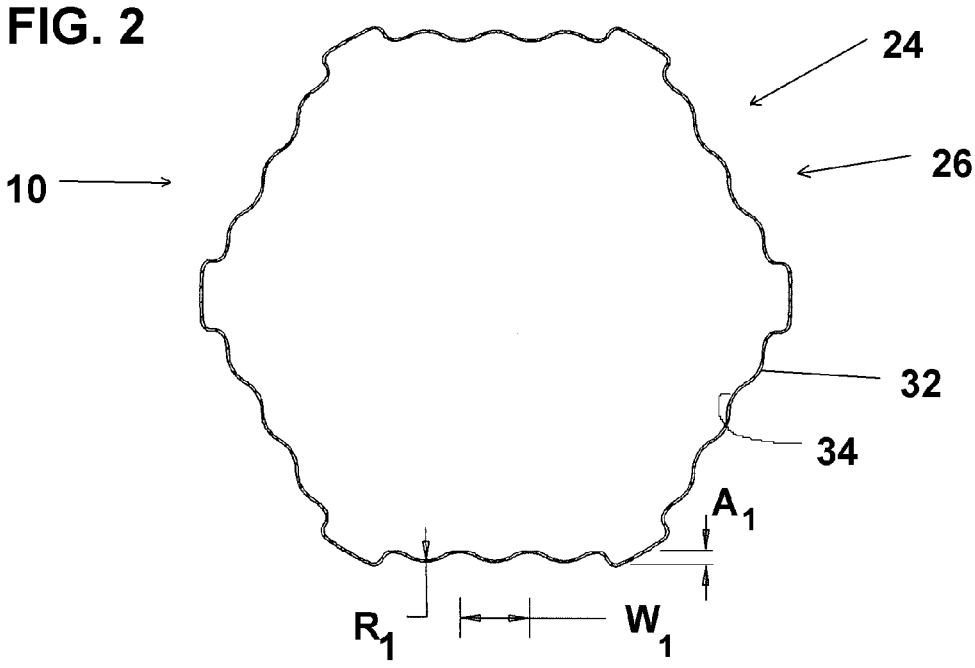
FIG. 2 is a cross-sectional view taken along lines 2-2 in FIG. 1.

According to one particularly advantageous feature of the invention, at least a portion of the vacuum panel areas 24 are formed as a plurality of undulations 26, which are best illustrated in FIG. 2. The undulations 26 are generally wave shaped and have a vertical component HL along a longitudinal axis that extends substantially from a first edge 28 of the vacuum panel area 24 to a second edge 30, as is best illustrated in FIG. 1.

The longitudinal axis of the undulations 26 is preferably substantially parallel to the longitudinal axis of the container 10 and a longitudinal axis of the vacuum panel area 24. Alternatively, in the event that the longitudinal axis of the vacuum panel area 24 would be oriented so that it is not parallel to the longitudinal axis of the container 10, the longitudinal axis of the undulations 26 would preferably be substantially parallel to the longitudinal axis of the vacuum panel area 24.

The undulations 26 preferably have a sinusoidal shape when viewed in transverse cross-section as is shown in FIG. 2, thereby defining a wavelength $W_1$ and a peak to peak amplitude $A_1$. Preferably, the undulations 26 are shaped so that the peak to peak amplitude is less than 25% of the wavelength. More preferably, the undulations 26 are shaped so that the peak to peak amplitude is less than about 20% of the wavelength, and most preferably the peak to peak amplitude is less than about 18% of the wavelength. Accordingly, the undulations 26 have an entirely different shape and proportions in comparison to ribs and similar structure that have been used in conventional hot fill type containers.

In the preferred embodiment, the wavelength of the undulations 26 is substantially constant throughout the vacuum panel area 24. Alternatively, however, the wavelength of the undulations could be modulated so that the wavelength is reduced in the central portions of the vacuum panel area 24 that would tend to experience more inward deflection is a result of volumetric shrinkage within the container 10. The amplitude of the undulations 26 could likewise be modulated so that it is greater through the central portions of the vacuum panel area 24. Modulating the wavelength and or amplitude of the undulations 26 in this manner would permit the achievement of optimal volumetric efficiency while permitting a certain amount of light weighting of the container 10 relative to embodiments in which the shape of the undulations 26 would remain constant throughout the vacuum panel area 24.

The undulations 26 are shaped in a manner that has a minimal effect on the flexibility of the vacuum panel area 24, particularly the flexibility to bend along a plane that is substantially parallel to the longitudinal axis of the undulations 26. In contrast, ribs tend to be more pronounced and to have a significant effect on the flexibility of the sidewall in which they are positioned in containers that are fabricated from PET.

The inwardly extending peaks 34 and the outwardly extending peaks 32 also preferably have a radius of curvature $R_1$ near the peak. Preferably, the inwardly extending peaks 34 and the outwardly extending peaks 32 have substantially the same radius of curvature $R_1$ near the peak.

Each vacuum panel area 24 preferably includes a plurality of such undulations 26, with each undulation 26 having an outwardly extending peak 32 and an inwardly extending peak 34.

The presence of the undulations 26 in the sidewall of the vacuum panel areas 24 provide an increased surface area relative to what a conventionally flat vacuum panel area sidewall surface would provide. Accordingly, the amount of volumetric shrinkage that may be accommodated through inward deflection of the vacuum panel areas 24 is substantially increased relative to what a flat surface would provide.

The outwardly extending peaks 32 and the inwardly extending peaks 34 within the undulations 26 are preferably substantially parallel to each other, as may be seen in FIG. 1.

In the preferred embodiment, the sidewall of the vacuum panel area 24 that forms the area of the undulations 26 has a substantially constant wall thickness.

Preferably, at least one of the undulations 26 extends along a longitudinal axis for a distance that is at least 0.75 inches, that more preferably is at least 1 inch and a most preferably is at least 1.5 inches. The sidewall that forms the vacuum panel areas 24 preferably has a maximum outer diameter $D_1$, and at least one of the undulations 26 preferably extends along a longitudinal axis for a distance that is at least 20% of the maximum outer diameter $D_1$. More preferably, at least one of the undulations 26 preferably extends along a longitudinal axis for a distance that is at least 30% of the maximum outer diameter $D_1$. Most preferably, at least one of the undulations 26 preferably extends along a longitudinal axis for a distance that is at least 40% of the maximum outer diameter $D_1$.

In the illustrated embodiment the vacuum panel areas 24 are provided with a central protrusion or island 36. However, it should be understood that alternative constructions that include no such island 36 also fall within the scope of the invention.

Figure 4:
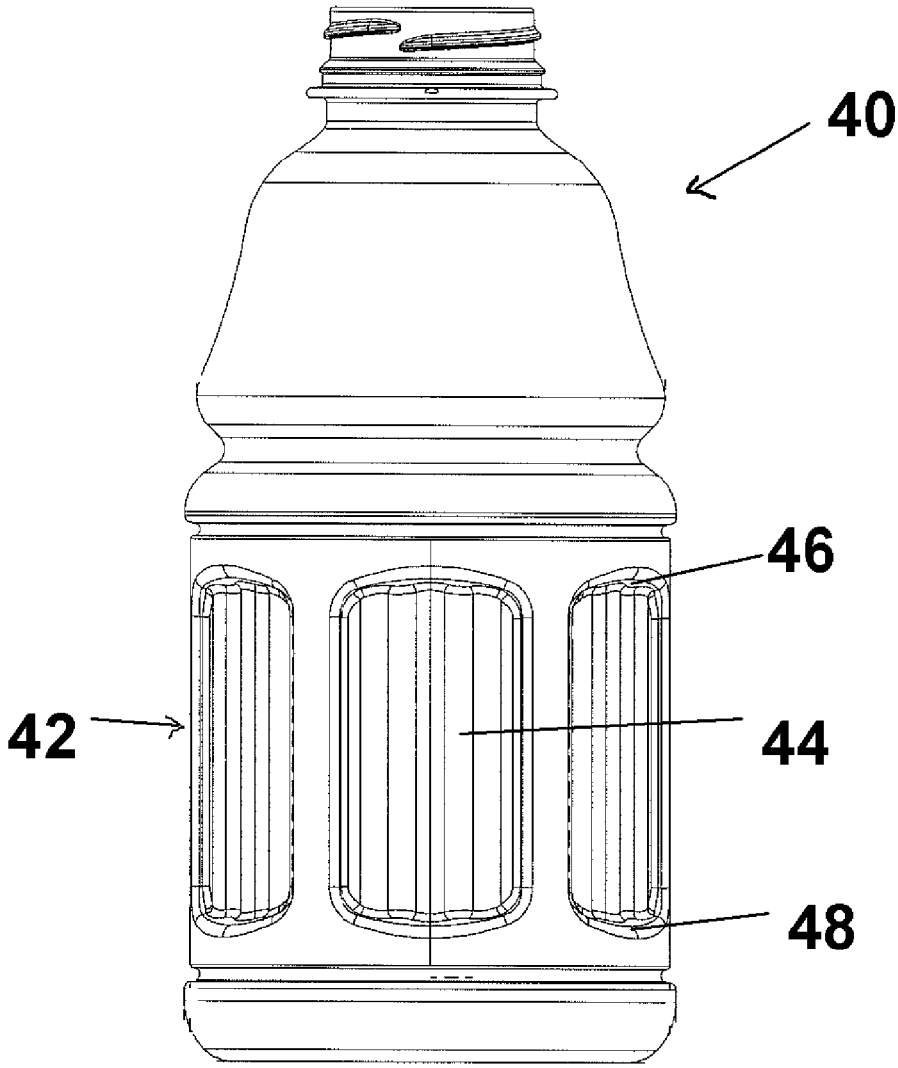
FIG. 4 is a side elevational view of an improved hot fill type container that is constructed according to an alternative embodiment of the invention.

Referring now to FIG. 4, a hot-fill type container 40 that is constructed according to an alternative preferred embodiment of the invention is identical to the hot fill container 10 described above except as is otherwise described herein. Hot-fill type container 40 includes a plurality of vacuum panel areas 42 that are provided with a plurality of undulations 44 that are generally wave shaped and are identical in their preferred construction to the undulations 26 described with respect to the embodiment discussed above. The undulations 44 have a vertical component along a longitudinal axis that extends substantially from a first edge 46 of the vacuum panel area 42 to a second edge 48, as is best illustrated in FIG. 4. In other words, the vacuum panel area 42 is constructed identically to the vacuum panel areas 24 described above except that no island is provided. A transverse cross-sectional view through the portion of the container 40 that includes the vacuum panel areas 42 would have an appearance that is substantially identical to that provided in FIG. 2.

According to another particularly advantageous aspect of the invention, a method of designing a volumetrically efficient hot fill container according to a preferred embodiment of the invention includes a step of modifying a conventional hot fill container design by designing a vacuum panel area for a volumetrically efficient hot fill container in which the sidewall of the volumetrically efficient hot fill container is formed as a plurality of undulations 26. The undulations 26 preferably have a vertical component and provide an increased surface area of the vacuum panel area 24 of the sidewall relative to what a flat surface would provide as described above.

The preferred method further includes a step of reducing an amount of plastic material to be used in the formation of the volumetrically efficient hot fill container relative to an amount of plastic material that was used to form the conventional hot fill container.

Figure 3:
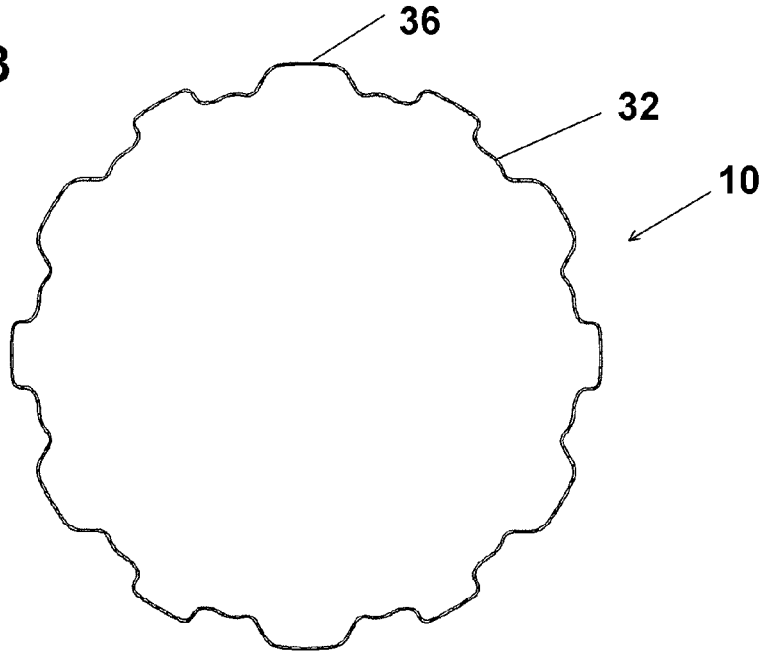
FIG. 3 is a cross-sectional view taken along lines 3-3 in FIG. 1.

In the preferred embodiment, the method is performed by designing a volumetrically efficient hot fill container 10 that has a plurality of the vacuum panel areas 24 defined therein, in accordance with the embodiment of the invention that is described above with reference to FIGS. 1-3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic hot fill container, comprising:

a sidewall having at least one vacuum panel defined therein, said at least one vacuum panel being defined by a vacuum panel of said sidewall that is constructed and arranged to flex inwardly in order to accommodate volumetric shrinkage that may occur within the container as a result of the hot fill process, and wherein at least a portion of said vacuum panel of said sidewall is formed as a plurality of undulations, said undulations having a vertical component and providing an increased surface area of said vacuum panel of said sidewall relative to what a flat surface would provide, wherein the amount of volumetric shrinkage that may be accommodated through inward deflection of said vacuum panel of said sidewall is increased relative to what a flat surface would provide.

2. A plastic hot fill container according to claim 1, wherein said sidewall has a plurality of said vacuum panels defined therein, and wherein each of said vacuum panels has a plurality of undulations defined therein.

3. A plastic hot fill container according to claim 1, wherein at least one of said undulations extends substantially from a first edge of said vacuum panel to a second edge of said vacuum panel.

4. A plastic hot fill container according to claim 1, wherein said undulations extend along an axis that is substantially vertical.

5. A plastic hot fill container according to claim 1, wherein said undulations are substantially parallel to each other.

6. A plastic hot fill container according to claim 1, wherein said vacuum panel of said sidewall has a substantially constant wall thickness.

7. A plastic hot fill container according to claim 1, wherein at least one of said undulations extends along a longitudinal axis for a distance of at least 0.75 inches.

8. A plastic hot fill container according to claim 7, wherein said at least one of said undulations extends along a longitudinal axis for a distance of at least 1 inch.

9. A plastic hot fill container according to claim 8, wherein said at least one of said undulations extends along a longitudinal axis for a distance of at least 1.5 inches.

10. A plastic hot fill container according to claim 1, wherein said sidewall has a maximum outer diameter, and wherein at least one of said undulations extends along a longitudinal axis for a distance that is at least 20% of said maximum outer diameter.

11. A plastic hot fill container according to claim 10, wherein said at least one undulation extends along a longitudinal axis for a distance that is at least 30% of said maximum outer diameter.

12. A plastic hot fill container according to claim 11, wherein said at least one undulation extends along a longitudinal axis for a distance that is at least 40% of said maximum outer diameter.

13. A plastic hot fill container according to claim 1, wherein said undulations are substantially sinusoidal in cross-section, having an amplitude and a wavelength.

14. A plastic hot fill container according to claim 13, wherein said amplitude is less than about 25% of said wavelength.

15. A plastic hot fill container according to claim 14, wherein said amplitude is less than about 20% of said wavelength.

16. A method of designing a volumetrically efficient hot fill container, comprising:

modifying a conventional hot fill container design by designing a vacuum panel for a volumetrically efficient hot fill container in which a sidewall of the volumetrically efficient hot fill container is formed as a plurality of undulations, said undulations having a vertical component and providing an increased surface area of said vacuum panel of said sidewall relative to what a flat surface would provide, wherein the amount of volumetric shrinkage that may be accommodated through inward deflection of said vacuum panel of said sidewall is increased relative to what a flat surface would provide; and reducing an amount of plastic material to be used in the formation of said volumetrically efficient hot fill container relative to an amount of plastic material that was used to form said conventional hot fill container.

17. A method comprising manufacturing a volumetrically efficient hot fill container that has been designed according to claim 16.

18. A method of designing a volumetrically efficient hot fill container according to claim 16, wherein said sidewall has a plurality of said vacuum panels defined therein, and wherein each of said vacuum panels has a plurality of undulations defined therein.

19. A method of designing a volumetrically efficient hot fill container according to claim 16, wherein at least one of said undulations extends substantially from a first edge of said vacuum panel to a second edge of said vacuum panel area.

20. A method of designing a volumetrically efficient hot fill container according to claim 16, wherein said undulations extend along an axis that is substantially vertical.

21. A method of designing a volumetrically efficient hot fill container according to claim 16, wherein said undulations are substantially parallel to each other.

22. A method of designing a volumetrically efficient hot fill container according to claim 16, wherein said vacuum panel of said sidewall has a substantially constant wall thickness.

23. A method of designing a volumetrically efficient hot fill container according to claim 16, wherein at least one of said undulations extends along a longitudinal axis for a distance of at least 0.75 inches.

24. A method of designing a volumetrically efficient hot fill container according to claim 23, wherein said at least one of said undulations extends along a longitudinal axis for a distance of at least 1 inch.

25. A method of designing a volumetrically efficient hot fill container according to claim 24, wherein said at least one of said undulations extends along a longitudinal axis for a distance of at least 1.5 inches.

26. A method of designing a volumetrically efficient hot fill container according to claim 16, wherein said sidewall has a maximum outer diameter, and wherein at least one of said undulations extends along a longitudinal axis for a distance that is at least 20% of said maximum outer diameter.

27. A method of designing a volumetrically efficient hot fill container according to claim 26, wherein said at least one undulation extends along a longitudinal axis for a distance that is at least 30% of said maximum outer diameter.

28. A method of designing a volumetrically efficient hot fill container according to claim 27, wherein said at least one undulation extends along a longitudinal axis for a distance that is at least 40% of said maximum outer diameter.

29. A method of designing a volumetrically efficient hot fill container according to claim 16, wherein said undulations are substantially sinusoidal in cross-section, having an amplitude and a wavelength.

30. A method of designing a volumetrically efficient hot fill container according to claim 29, wherein said amplitude is less than about 25% of said wavelength.

31. A method of designing a volumetrically efficient hot fill container according to claim 30, wherein said amplitude is less than about 20% of said wavelength.

* * * * *